US006611184B2

(12) United States Patent
Hoffmann

(10) Patent No.: US 6,611,184 B2
(45) Date of Patent: Aug. 26, 2003

(54) RELAY

(75) Inventor: Ralf Hoffmann, Berlin (DE)

(73) Assignee: Tyco Electronics Amp GmbH, Bensheim (DE)

( * ) Notice: Subject to any disclaimer, the term of this patent is extended or adjusted under 35 U.S.C. 154(b) by 18 days.

(21) Appl. No.: 10/202,582

(22) Filed: Jul. 24, 2002

(65) Prior Publication Data

US 2003/0030520 A1 Feb. 13, 2003

(30) Foreign Application Priority Data

Jul. 27, 2001 (GB) ..... 0118327

(51) Int. Cl.[7] ..... H01H 51/22; H01H 67/02

(52) U.S. Cl. ..... 335/78; 335/80; 335/83; 335/85; 335/86; 335/129

(58) Field of Search ..... 335/78–86, 106, 335/133, 127, 128, 129

(56) References Cited

U.S. PATENT DOCUMENTS 5,864,270 A 1/1999 Hoffman ..... 335/78
5,903,201 A * 5/1999 Reiss ..... 335/128
6,140,895 A 10/2000 Dittmann et al. ..... 335/80

OTHER PUBLICATIONS

British Search Report, Oct. 2001.

* cited by examiner

*Primary Examiner*—Ramon M. Barrera

(57) ABSTRACT

An electromagnetic relay having a base and an armature. The base having a first fixed contact support having a first fixed contact and a second fixed contact support having a second fixed contact. The armature having a first end and a second end. A contact bridge mechanically coupled to the first end by a transfer spring and having a first moveable contact and a second moveable contact. The contact bridge positioned between the first fixed contact support and the second fixed contact support such that the first fixed contact is substantially adjacent to the first moveable contact and the second fixed contact is substantially adjacent to the second moveable contact. An armature spring positioned on the second end of the armature for urging the contact bridge toward the first fixed contact.

8 Claims, 4 Drawing Sheets

RELAY

BACKGROUND OF THE INVENTION

The invention relates to an electromagnetic relay. More particularly, the invention relates to an electromagnetic relay suitable for switching loads at DC voltages exceeding 24V for use in applications such as an automobile.

DESCRIPTION OF THE PRIOR ART

Examples of conventional electromagnetic relays are disclosed in U.S. Pat. Nos. 5,864,270 and 6,140,895. These relays are manufactured to switch loads at voltages below 24V. Because many applications require a greater load range, typically exceeding 15A, these relays can not adequately accommodate applications where higher currents are required. In addition, conventional relays typically have a single set of opening contacts or a single set of closing contacts. A single set of opening or closing contacts is not sufficient for many applications.

It is, therefore, desirable to provide an electromagnetic relay having more than one set of opening and/or closing contacts and being suitable for switching DC voltages exceeding 24V and currents exceeding 15A. It is also desirable that the relay be both compact and economical.

SUMMARY OF THE INVENTION

The invention relates to an electromagnetic relay. The elctromagneic relay having an armature which is mechanically coupled to a moveable contact bridge by a transfer spring. A torsion bar is attached to the transfer spring and extends substantially transversely to the contact bridge. An armature spring is provided for urging the armature towards a resting position.

DETAILED DESCRIPTION OF THE PREFERRED EMBODIMENT

Figure 1:
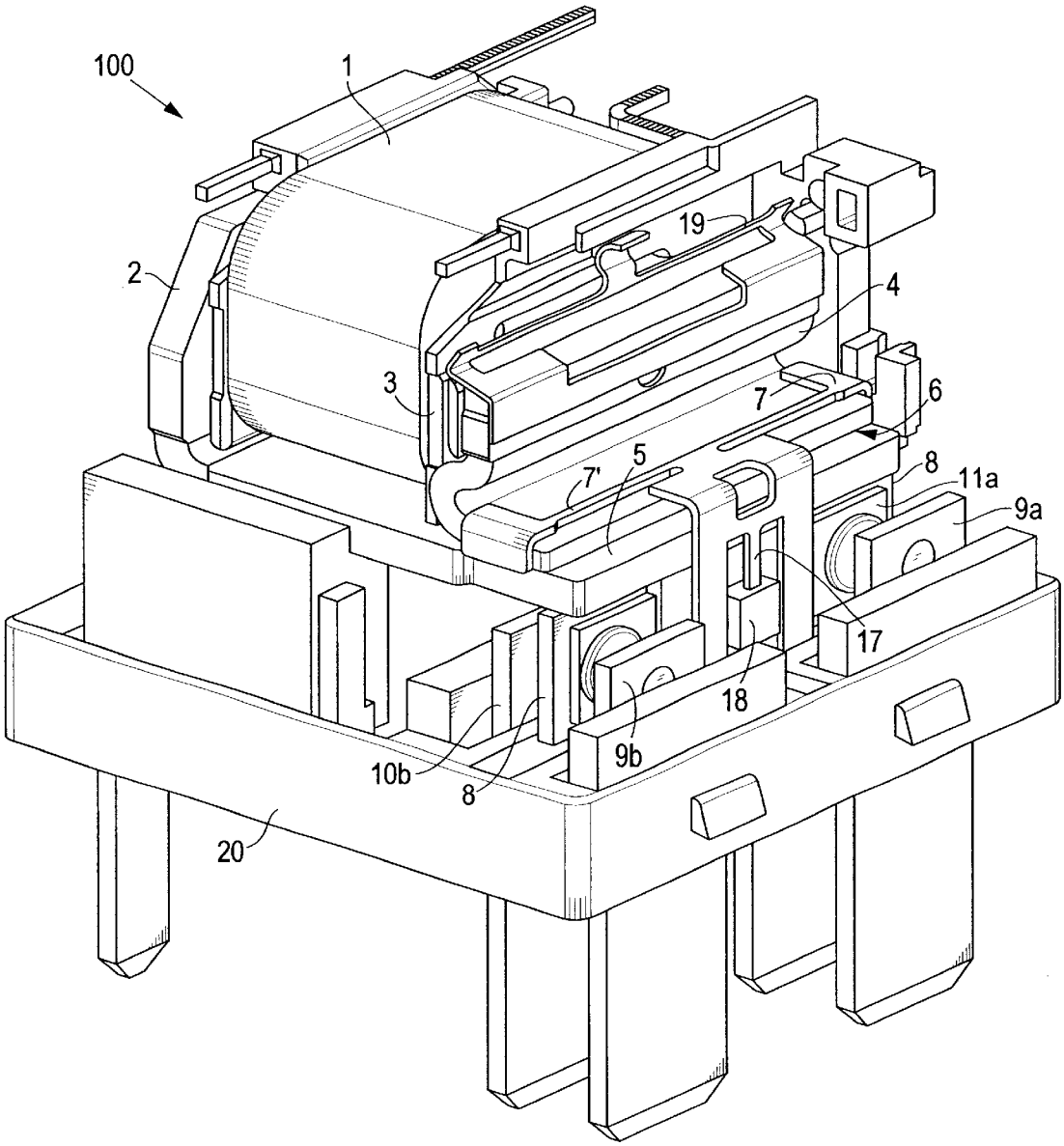
FIG. 1 is a perspective view of a relay according to the present invention.
Figure 2:
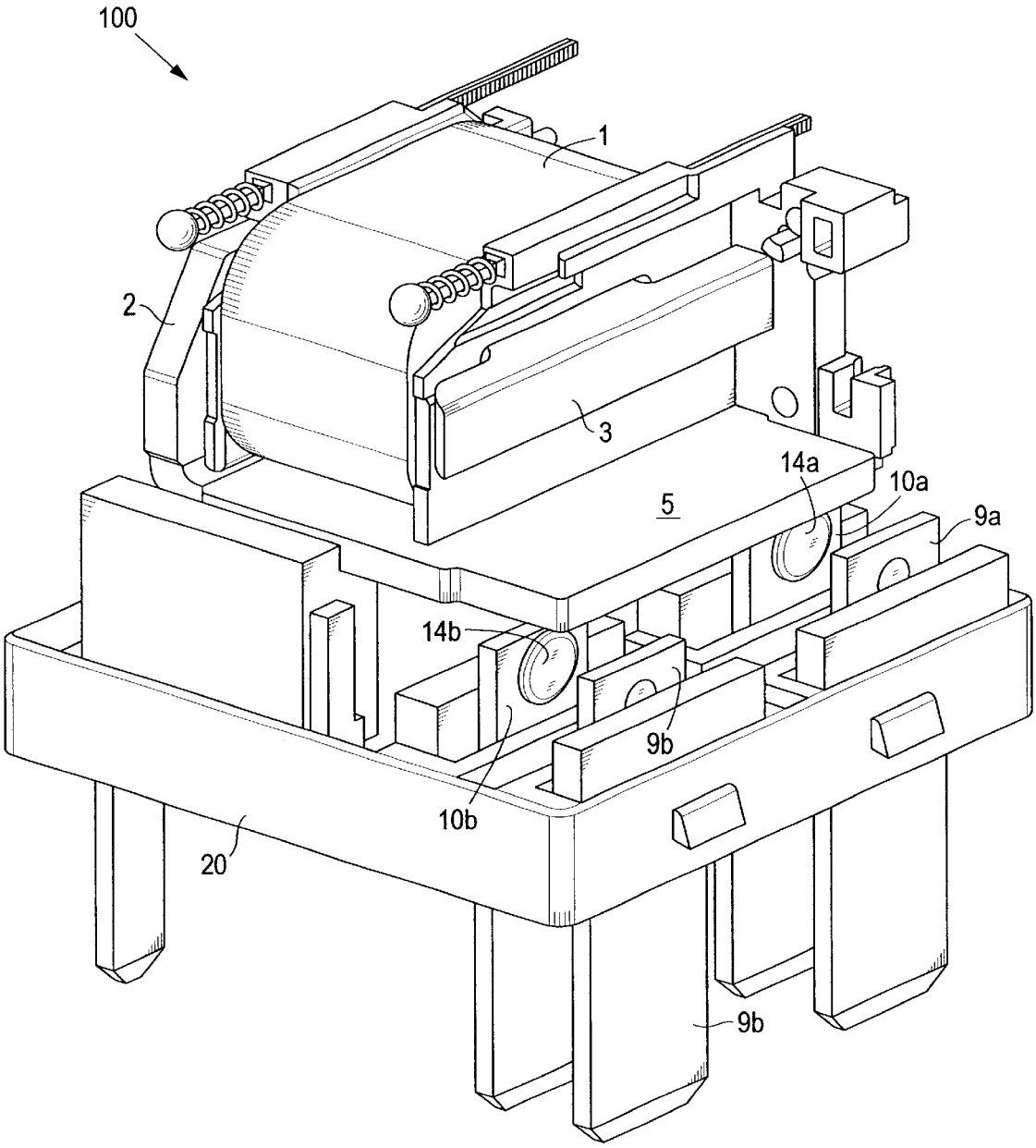
FIG. 2 is a perspective view of the relay of FIG. 1 with some parts removed for clarity.
Figure 3:
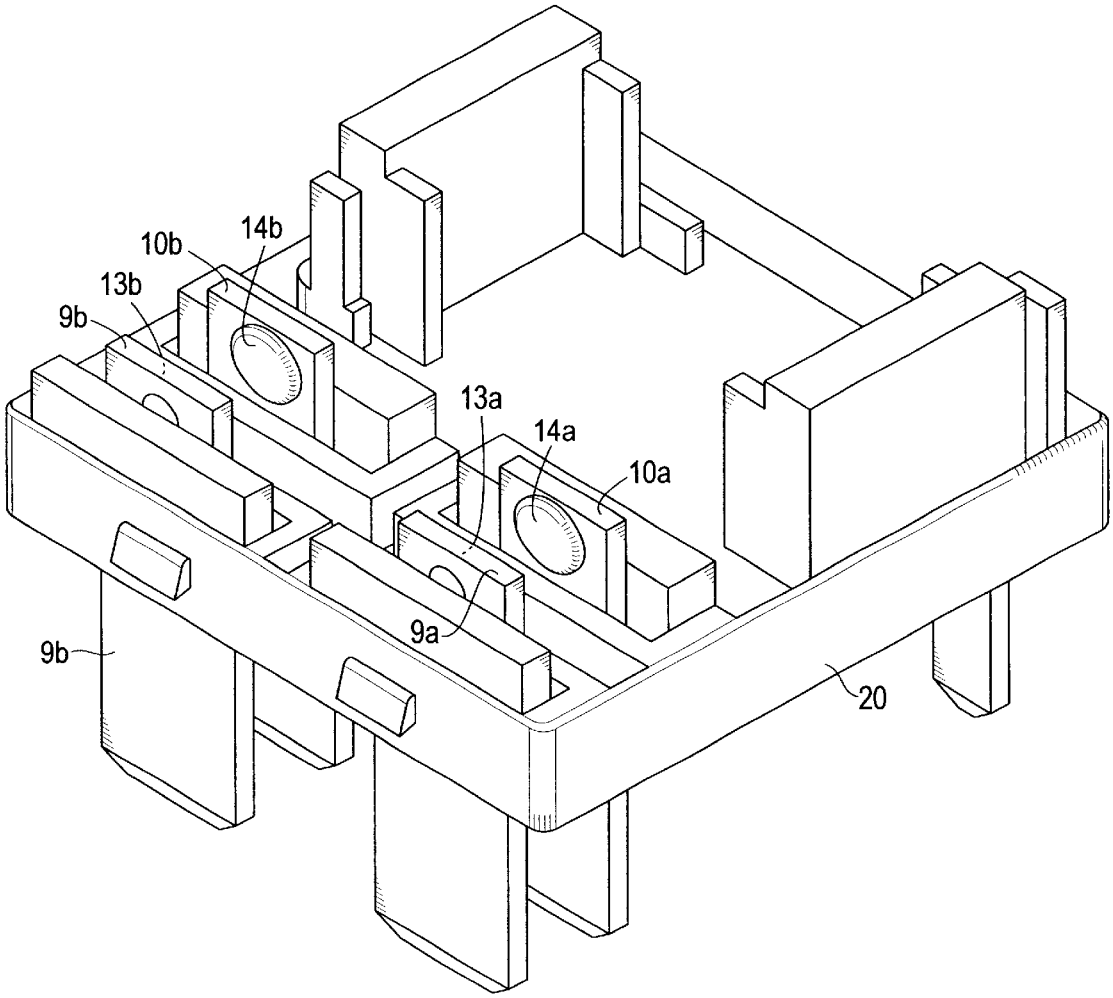
FIG. 3 is a perspective view of a base of the relay of FIG. 1.

As shown in FIG. 1, electromagnetic relay 100 has a base 20, a coil 1, a yoke 2 and a core 3. As shown in FIG. 3, the base 20 has fixed contact supports 9*a*, 9*b*, 10*a*, 10*b*. The fixed contact supports 9*a*, 9*b*, 10*a*, 10*b* extend through the base 20 to connection pins for electrically connecting the relay 100 to circuitry (not shown). Each fixed contact support 9*a*, 9*b*, 10*a*, 10*b* is provided with a fixed contact 13*a*, 13*b*, 14*a*, 14*b*, respectively.

Figure 4:
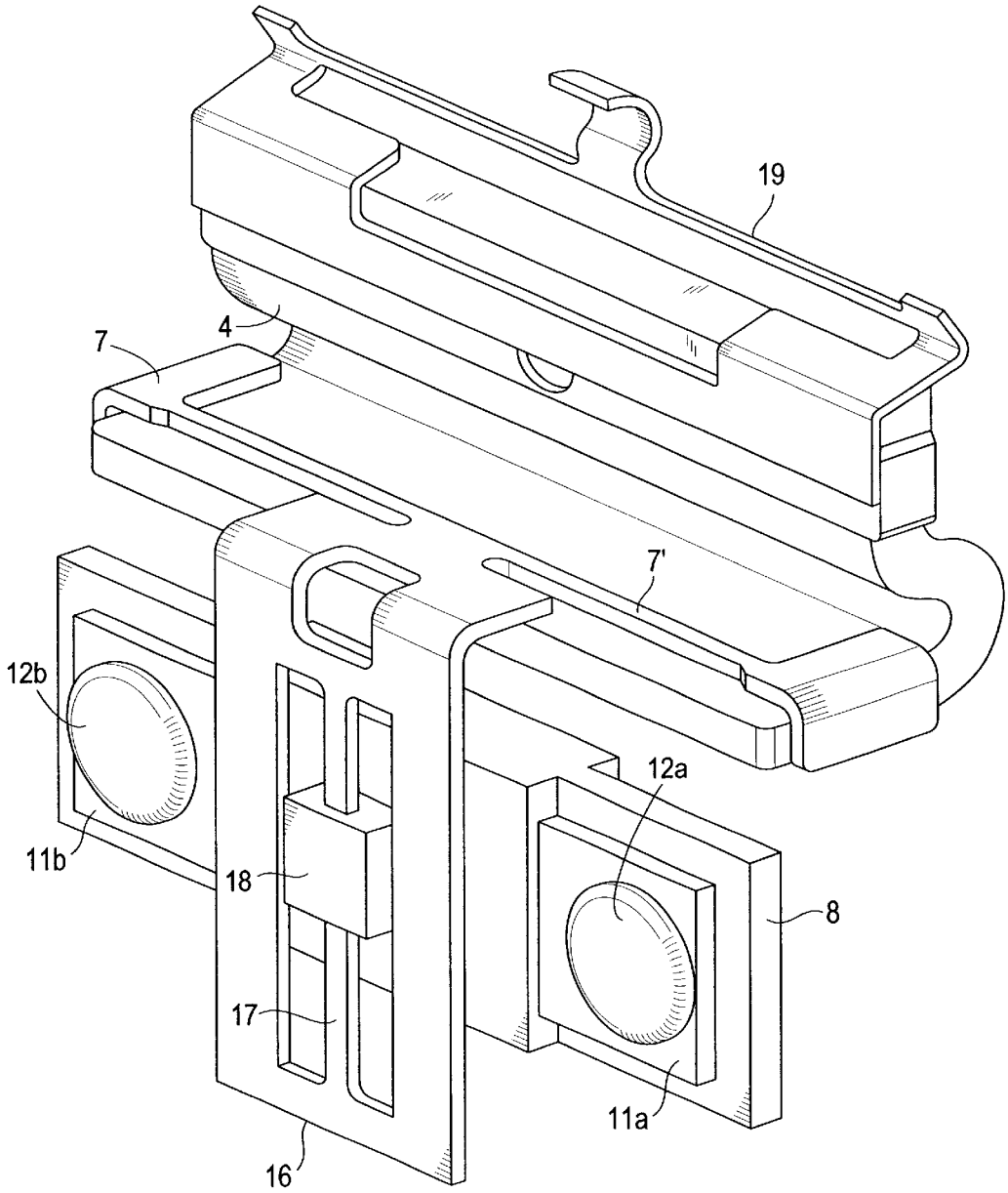
FIG. 4 is a perspective view of a contact bridge of the relay of FIG. 1.

As shown in FIG. 1, the yoke 2 has a yoke pole surface 5 positioned adjacent to an armature 4. The armature 4 has an armature pole surface 6 and an armature spring 19. Shown in FIG. 4, the armature spring 19 is positioned at a first end of the armature 4 and is preferably made from a flexible material having a relatively low stiffness so to allow movement of the armature 4 with little mechanical resistance. The armature pole surface 6 is positioned at a second end of the armature 4 and has a transfer spring 7.

The transfer spring 7 preferably has a torsion bar 7' extending substantially transversely to the direction of movement to increase the stiffness of the transfer spring 7. A relatively stiff frame 16 extends at essentially a right angle from the torsion bar 7'. A support rod 17 extends through a middle of the frame 16. A support member 18 is fixed to the support rod 17. The support rod 17 has a substantially smaller width than members of the frame 16 enabling the support rod 17 to be relatively flexible.

The support member 18 is attached to a moveable contact bridge 8. Moveable contact supports 11*a*, 11*b* are mounted on a front of the contact bridge 8. Moveable contacts 12*a*, 12*b* are mounted on the moveable contact supports 11*a*, 11*b*. Moveable back contact supports are mounted on a back of the contact bridge 8 and moveable back contacts are mounted on the moveable back contact supports in a position mirroring the moveable contact supports 11*a*, 11*b* and the moveable contacts 12*a*, 12*b*.

The support member 18 provides desirable resilience in the direction of movement while maintaining a desirable degree of stiffness transversely to the direction of movement, allowing an advantageous transfer of available force onto the contact bridge 8. The torsion bar 7' allows torsion of the support rod 17 and hence some rotation of the contact bridge 8 relative to the frame 16 and the transfer spring 7. The rotation of the contact bridge 8 and the transfer spring 7, however small, allows the moveable contacts 12*a*, 12*b* to move between the fixed contacts 13*a*, 13*b*, 14*a*, 14*b*.

The operation of the relay 100 will now be described with reference to FIGS. 1 through 4. In a resting state, the armature spring 19 urges the armature 4 into a resting position. In the resting position, the transfer spring 7 transfers the spring force onto the contact bridge 8 to cause the moveable contacts 12*a*, 12*b* to contact the fixed contacts 13*a*, 13*b*. When the coil 1 is powered, the armature 4 is moved from the resting position and pivots so that the armature pole surface 6 tangentially approaches the yoke pole surface 5. The transfer spring 7 transfers the armature 4 movement onto the contact bridge 8, which then moves away from the fixed contacts 13*a*, 13*b*. The opposite set of fixed contacts 14*a*, 14*b* is contacted before the armature 4 reaches a final position.

It will be understood by those skilled in the art that the present invention is not limited to the embodiments shown herein and that additions and modifications are possible without departing from the scope of the invention.

I claim:

1. An armature for an electromagnetic relay, comprising:

a moveable contact bridge mechanically coupled to the armature by a transfer spring;

a torsion bar attached to the transfer spring that extends substantially transversely to the contact bridge; and an armature spring for urging the armature towards a resting position.

2. The armature of claim 1, wherein the torsion bar comprises a frame having a support rod extending therethrough and a contact bridge support member mounted on the support rod for attachment to the contact bridge.

3. The armature of claim 2, wherein the contact bridge comprises moveable contacts.

4. The armature of claim 3, wherein the moveable contacts are attached to moveable contact supports.

5. An electromagnetic relay, comprising:

a base having a first fixed contact support having a first fixed contact and a second fixed contact support having a second fixed contact;

an armature having a first end and a second end;

a contact bridge mechanically coupled to the first end of the armature by a transfer spring and having a first moveable contact and a second moveable contact;

the contact bridge positioned between the first fixed contact support and the second fixed contact support such that the first fixed contact is substantially adjacent to the first moveable contact and the second fixed contact is substantially adjacent to the second moveable contact;

an armature spring positioned on the second end of the armature for urging the contact bridge toward the first fixed contact.

6. The electromagnetic relay of claim 5, wherein the transfer spring comprises a torsion bar that extends substantially transversely to the contact bridge.

7. The armature of claim 6, wherein the torsion bar comprises a frame having a support rod extending therethrough and a contact bridge support member mounted on the support rod for attachment to the contact bridge.

8. The armature of claim 5, wherein the moveable contacts are attached to moveable contact supports.

* * * * *